US005695904A

United States Patent [19]

Larson et al.

[11] Patent Number: 5,695,904

[45] Date of Patent: Dec. 9, 1997

[54] SEMI-DRY DEVELOPERS AND PROCESSES THEREOF

[75] Inventors: James R. Larson, Fairport; Joseph Mammino, Penfield, both of N.Y.

[73] Assignee: Xerox Corporation, Stamford, Conn.

[21] Appl. No.: 932,123

[22] Filed: Aug. 19, 1992

[51] Int. Cl.[6] ..... G03G 9/08

[52] U.S. Cl. ..... 430/119; 430/115; 430/97; 430/137

[58] Field of Search ..... 430/119, 114, 430/115, 137

[56] References Cited

U.S. PATENT DOCUMENTS

| | | | |
|---|---|---|---|
| 3,035,003 | 5/1962 | Kessler | 260/28.5 |
| 3,234,017 | 2/1966 | Heyl et al. | 96/1 |
| 3,234,018 | 2/1966 | Wendt | 96/1 |
| 3,652,315 | 3/1972 | Matsuo et al. | 117/17.5 |
| 3,838,064 | 9/1974 | Vogt et al. | 252/384 |
| 3,838,092 | 9/1974 | Vogt et al. | 260/33.6 F |
| 3,977,871 | 8/1976 | Crooks | 96/15 D |
| 4,670,370 | 6/1987 | Taggi | 430/137 |
| 4,707,429 | 11/1987 | Trout | 430/115 |
| 4,760,009 | 7/1988 | Larson | 430/137 |
| 4,783,389 | 11/1988 | Trout et al. | 430/137 |
| 4,812,383 | 3/1989 | Foote | 430/126 |
| 4,814,251 | 3/1989 | Igoe | 430/115 |
| 4,923,778 | 5/1990 | Blair et al. | 430/137 |
| 4,994,341 | 2/1991 | Adair et al. | 430/115 |
| 5,017,451 | 5/1991 | Larson et al. | 430/137 |
| 5,019,477 | 5/1991 | Felder | 430/115 |
| 5,306,590 | 4/1994 | Felder | 430/115 |

FOREIGN PATENT DOCUMENTS

| | | | |
|---|---|---|---|
| 1077413 | 7/1967 | United Kingdom | G03G 1/20 |

OTHER PUBLICATIONS

McGraw Hill Encyclopedia of Science and Technology, vol. 7, pp. 107–110, 6th Ed.

Van Nostrand's Scientific Encyclopedia, pp. 1146–1148, 7th Ed.

"Teflon K–10 Developer"; Xerox Disclosure Journal; vol. 4, No. 5, Sep./Oct. 1979; p. 623.

"Cohesive Toner"; Xerox Disclosure Journal; vol. 5, No. 2, Mar./Apr. 1980, p. 183.

*Primary Examiner*—S. Rosasco

*Attorney, Agent, or Firm*—Zosan S. Soong

[57] ABSTRACT

A dry electrostatographic process involving the development of the latent image using a semi-dry developer having a solids content ranging from about 50% to about 99% by weight based on the weight of the semi-dry developer, and wherein the semi-dry developer is prepared by a developer preparation process comprising: (i) removing liquid from a liquid developer in an effective amount to yield the semi-dry developer; or (ii) adding a liquid additive to a dry developer containing toner particles ranging in size of from about 1 to 7 microns in an effective amount to yield the semi-dry developer.

14 Claims, 1 Drawing Sheet

SEMI-DRY DEVELOPERS AND PROCESSES THEREOF

This invention relates generally to electrostatographic copying and printing processes and to processes for making semi-dry developers, and more particularly is directed to methods for using semi-dry developers in dry electrostatographic processes, especially xerographic imaging and printing, and methods for preparing semi-dry developers from liquid or dry developers. The field of electrostatography includes electrophotography and electrography. Electrophotography employs a photosensitive medium to form, with the aid of electromagnetic radiation, an electrostatic latent charge pattern. Electrography utilizes an insulating medium to form without the aid of electromagnetic radiation, the electrostatic latent charge pattern. In the foregoing processes, the electrostatic latent image is developed with toner particles which are ultimately transferred to a sheet of support material. Hereinafter, the present invention will be illustrated in the context of electrophotographic printing processes and machines, but it is to be understood that the present invention is also suitable in electrographic processes and apparatuses, and the like.

The following electrostatographic copying and printing processes and methods for making liquid and dry developers are known.

Matsuo et al., U.S. Pat. No. 3,652,315, discloses a developing powder for electrophotography comprising toner particles coated with a non-volatile liquid such as silicone oil, Teflon oil, or liquid paraffin.

Kessler, U.S. Pat. No. 3,035,003, discloses the use of molten paraffin wax in the preparation of toner particles to obtain toner particles with uniform pigmentation.

Heyl et al., U.S. Pat. No. 3,234,017, discloses toner particles coated with an antistatic agent which may be sulphurated oils, alkyl sulphonates, long-chain alcohols, ethers or esters, phosphoric acid esters, polymethacrylic acid, or polyethylene oxide derivatives.

Wendt, U.S. Pat. No. 3,234,018, discloses a method for developing copies using electrophotographic layers.

Great Britain Patent Document No. 1,077,413, discloses a developer containing liquid in a concentration of about 0.025 to 1.0% by weight of the carrier. The liquid may be, for example, hydrocarbon oils, vegetable oils, or organopolysiloxane oils.

McGraw-Hill Encyclopedia of Science & Technology, Vol. 7, pp. 107–110 (6th Ed.) and Van Nostrand's Scientific Encyclopedia, pp. 1146–1148 (7th Ed.) disclose various filtration methods and apparatuses.

Liquid developers and methods for the preparation of liquid developers are disclosed in Larson et al., U.S. Pat. No. 4,760,009; Taggi, U.S. Pat. No. 4,670,370; Trout et al., U.S. Pat. No. 4,783,389; Larson et al., U.S. Pat. No. 5,017,451; Trout, U.S. Pat. No. 4,707,429; Felder, U.S. Pat. No. 5,019,477; and Adair et al., U.S. Pat. No. 4,994,341.

Blair et al., U.S. Pat. No. 4,923,778, discloses the addition of liquid dispersant to a liquid developer having a solids content of from 22% to 50% by weight to yield a liquid developer having a solids content of 0.1 to 10% by weight.

The use of polytetrafluoroethylene to produce dustless compositions is disclosed in Crooks, U.S. Pat. No. 3,977,871; Vogt et al., U.S. Pat. No. 3,838,092; Vogt et al., U.S. Pat. No. 3,838,064; Maniar, Xerox Disclosure Journal, Vol. 4, No. 5, p. 623 (September/October 1979); and Maniar, Xerox Disclosure Journal, Vol. 5, No. 2, p. 183 (March/April 1980).

Foote, U.S. Pat. No. 4,812,383, discloses a process for developing an electrostatic latent image with a liquid developer comprising a liquid component that is present in an amount of from about 50 to about 98% by weight.

Igoe, U.S. Pat. No. 4,814,251, discloses a concentrated liquid developer composition containing a dispersing liquid that is present in an amount of from about 60 to about 80% by weight. This concentrated developer is then diluted with an additional amount of the dispersing liquid.

SUMMARY OF THE INVENTION

It is an object of the present invention to provide a dry electrostatographic process involving the development of the latent image by a semi-dry developer, wherein the semi-dry developer is prepared by removing a portion of the liquid from a liquid developer or by adding liquid to a dry developer.

It is an additional object to provide a process for preparing a semi-dry developer involving the removal of a portion of the liquid from a liquid developer or the addition of liquid to a dry developer.

It is a further object to provide a developer composition exhibiting reduced toner dusting in a dry electrostatographic process, including in embodiments of the present invention developer compositions containing small toner particles such as from 1 to about 10 microns or even smaller ranges such as from 1 to about 3 microns in size.

Another object is to provide in certain embodiments a semi-dry developer wherein the liquid contained therein is a release agent useful for reducing toner offset.

These objects and others are accomplished by providing a dry electrostatographic process comprising:

(a) creating a latent image; and (b) developing the latent image in a dry development process with a semi-dry developer having a solids content ranging from about 50% to about 99% by weight based on the weight of the semi-dry developer, and wherein the semi-dry developer is prepared by a process comprising: (i) removing liquid from a liquid developer in an effective amount. In another embodiment of the present invention, there is provided a dry electrostatographic process comprising:

(a) creating a latent image; and (b) developing the latent image in a dry development process with a semi-dry developer containing toner particles ranging in size of from about 1 to 7 microns and having a solids content ranging from about 50% to about 90% by weight based on the weight of the semi-dry developer, and wherein the semi-dry developer is prepared by a process comprising: (ii) adding a liquid additive in an effective amount to a dry developer containing toner particles ranging in size of from about 1 to 7 microns.

The phrase "solids content," as used in the context of liquid and semi-dry developers, refers to all solid developer components and therefore does not include the liquid dispersant. Thus, "solids content" includes the toner composition and if present in the developer, flow agents, charge control agents, and carrier particles. Developers may be referred to as single (i.e., toner) or two component (i.e., toner and carrier) developers. It is understood that the weight percents of the solids content are based on the total weight of the developer, including carrier particles if present.

DETAILED DESCRIPTION

Figure 1:
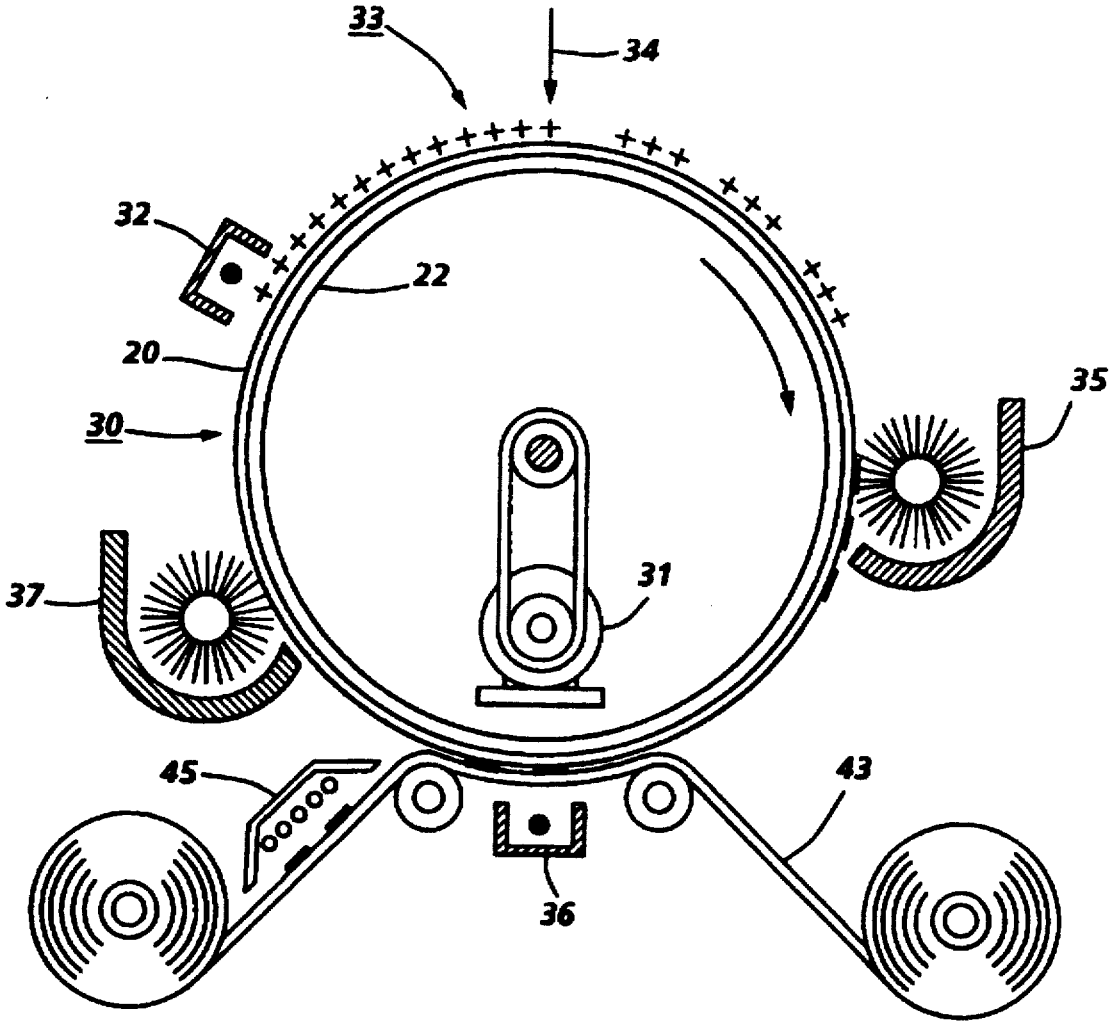
FIG. 1 is a partially schematic illustration of a xerographic imaging device which is one embodiment for accomplishing the present invention.

Referring now to FIG. 1, there is shown a schematic illustration of an embodiment of an automatic xerographic copying apparatus, wherein a xerographic plate comprising a photoconductive layer 20, for example, comprising amorphous selenium, zinc oxide, selenium/tellurium, or selenium/tellurium/arsenic, and the like in a binder on a conductive substrate 22 in the form of a drum 30 is rotated by a motor 31 and sequentially passes a sensitizing station 32 illustrated as a corona discharge device depositing illustratively positive charge on the plate, an exposure station 33 where an optical image illustrated by light ray 34 is projected onto the surface of the charged drum, a developing station 35 depicted as a brush development device, a transfer station 36 illustratively using a corona device for electrostatic transfer and cleaning station 37 depicted as a brush cleaning device.

At exposure station 33, the imagewise illuminated areas of the drum become more electrically conductive and at least partially discharge the surface of drum 30 in said areas to thereby create a latent electrostatic image corresponding to the optical image which is rendered visible or developed at developing station 35 and then transferred to a transfer web at transfer station 36. The transferred image on web 43 is fixed at fixing station 45 depicted as a heat fixing device. After transfer of the image, residual developer is removed from the xerographic drum surface at cleaning station 37 and the drum is then resensitized by corona charging at sensitizing station 32 to prepare it for another imaging cycle. In another embodiment, the latent image alternatively may be recorded by exposing the charged surface to controlled laser emissions in a raster output scanner system.

The latent electrostatic image may be rendered visible or developed by contacting the latent image areas with semi-dry toner in single or two component development. Any suitable dry developing method may be used including cascade development illustrated in U.S. Pat. No. 4,015,561; magnetic brush development illustrated in U.S. Pat. No. 3,967,892; fur brush development illustrated in U.S. Pat. No. 3,841,265; scavengeless development illustrated in U.S. Pat. No. 5,053,824; and jumping development illustrated in U.S. Pat. No. 4,660,059, the disclosures of all of the above being totally incorporated by reference.

Alternative fixing methods that may be employed in the present invention include providing the application of heat and pressure substantially concurrently by various means: a roll pair maintained in pressure contact; a belt member in pressure contact with a roll; and the like. Heat may be applied by heating one or both of the rolls, plate members or belt members. The fusing of the toner particles takes place when the proper combination of heat, pressure and contact time are provided. The balancing of these parameters to bring about the fusing of the toner particles can be effected to suit particular machines or process conditions.

Illustrative fuser members, release agents and fusing systems are described in U.S. Pat. No. 4,264,181 to Lentz et al., U.S. Pat. No. 4,257,699 to Lentz and U.S. Pat. No. 4,272,179 to Seanor, the disclosures of which are totally incorporated by reference. These patents describe fuser members and methods of fusing thermoplastic resin toner images to a substrate wherein a polymeric release agent having functional groups is applied to the surface of the fuser member. The fuser member can comprise a base member having an elastomeric surface with a metal containing filler therein which has been cured with a nucleophilic addition curing agent. Exemplary of such fuser member is an aluminum base member with a poly (vinylidenefluoride-hexafluoropropylene) copolymer cured with bisphenol curing agent having lead oxide filler dispersed therein and utilizing a mercapto functional polyorganosiloxane oil as a release agent. In these fusing processes, the polymeric release agents have functional groups (also designated as chemically reactive functional groups) which interact with the metal containing filler dispersed in the elastomer or resinous material of the fuser member surface to form a thermally stable film which releases thermoplastic resin toner and which prevents the thermoplastic resin toner from contacting the elastomer material itself. The metal oxide, metal salt, metal alloy or other suitable metal compound filler dispersed in the elastomer or resin upon the fuser member surface interacts with the functional groups of the polymeric release agent. Preferably, the metal containing filler materials do not cause degradation of or have any adverse effect upon the polymeric release agent having functional groups. Because of the reaction between the elastomer having a metal containing filler and the polymeric release agent having functional groups, excellent release and the production of high quality copies may be obtained even at high rates of speed of electrostatographic reproducing machines.

In embodiments of the present invention, the semi-dry developer is prepared by a process involving the removal of an effective amount of the liquid from a liquid developer to yield the semi-dry developer. Any suitable technique and apparatus may be employed to concentrate the solids contents to the desired level. One concentration technique suitable for the present invention is filtration involving the use of cake filters. There are primarily three classes of cake filters, depending on the driving force producing the separation. In pressure filters, superatmospheric pressure is applied by pump or compressed gas to the feed slurry, and filtrate is discharged at atmospheric pressure, or higher. In vacuum filters, the pressure of the atmosphere is the driving force, a vacuum being applied to the filtrate collection chamber. In centrifugal filters, centrifugal force causes the filtrate to flow through the cake and filter medium. Cake filters are also classified as batch-operating or continuous. In general, pressure filters are batch or intermittent filters, vacuum filters are continuous machines, and centrifugal filters may be either. Pressure filters include filter presses, horizontal plate filters, leaf filters, and the like. Forms of vacuum filters include rotary-drum, rotary-disk, horizontal belt, and horizontal pan or table filters, and the like. Preferably, pressure filters are employed in the present invention at a pressure ranging from about 60 to about 2,500 psig. A preferred pressure range is from about 200 to about 1,500 psig. Pressure filtration equipment is available for example from Waste-Tech, Inc. (Charlestown Engineering High Pressure Filtration Tube Presses) and Larox, Inc. (Larox Automatic Pressure Filters). Depending on the composition and amount of the liquid developer to be concentrated, pressure filtration typically may be accomplished in about 30 seconds to about 20 hours, and preferably about 30 minutes to about 5 hours.

Another method that may he used to concentrate the liquid developer is blotting. This method involves placing the liquid developer between absorbent materials such as paper towels and squeezing out the liquid into the absorbent materials by using, for example, either a hydraulic press or a mangle. Larger scale blotting may be accomplished by placing the liquid developer on a continuous cloth belt, vacuuming out some of the liquid, and then squeezing out more liquid between hydraulically operated rollers to result in a high solids cake. Other techniques that may be employed to increase the solids content in the liquid developer include centrifugal sedimentation and electrostatic deposition. It is understood that the various concentration methods may be used independently or combined.

In one embodiment, removal of a portion of the liquid component of the liquid developer results in a semi-dry single component developer. Effective amounts of a carrier may optionally be mixed with the semi-dry single component developer to form a semi-dry two component developer.

In embodiments of the present invention, the semi-dry developer is prepared by adding a liquid additive to a dry developer in an effective amount to yield the semi-dry developer having the desired solids content. Any suitable method and apparatus may be employed to add the liquid additive to the dry developer. The liquid additive may be added continuously or at one time or several times and is preferably mixed with the dry developer by any suitable means such as blending. The dry developer may be either a single or two component developer. In one embodiment, liquid additive is added to a dry single component developer to yield the semi-dry single component developer. Subsequently, effective amounts of a carrier may optionally be mixed with the semi-dry single component developer to form a semi-dry two component developer.

The liquid medium of the liquid developer, which is partially removed in embodiments of the present invention, and the liquid added to the dry developer may be the same or different from one another and may be any suitable liquid dispersant typically used for liquid developers. Although volatile liquids may be used, non-volatile and low volatile liquids are preferred. Illustrative examples of suitable liquids include hydrocarbons, such as alkanes having from 1 to about 25 carbon atoms, such as Norpar® 12, 13, and 15 available from Exxon Corporation, and including isoparaffinic hydrocarbons such as Isopar® G, H, K, L, and M available from Exxon Corporation, Amsco® 460 Solvent and Amsco® OMS, available from American Mineral Spirits Company, Soltrol® available from Phillips Petroleum Company, Pagasol®, available from Mobil Oil Corporation, Shellsol® available from Shell Oil Company, and the like. Other suitable liquid media include chlorofluorocarbons such as Freon 113, trichlorotrifluoroethane (Du Pont Corporation), tetrachlorotetrafluoropropane (K & K Laboratories); perfluoroalkanes such as perfluorodecalin (Aldrich) and perfluorooctane (K & K Laboratories); Silicone Oils (General Electric Company); polydimethylsiloxane fluids (Petrarch, Inc.). In one embodiment of the present invention, the liquid added to the dry developer may be in solid form at room temperature, i.e., at 25° C., but is in liquid form in the developer zone when the developer subsystem is at a higher temperature.

In embodiments of the present invention, sufficient liquid is added to the dry developer or removed from the liquid developer to yield a semi-dry developer having a solids content of about 50% to about 99%, especially about 50% to about 90%, preferably about 60% to about 95%, more preferably about 70% to about 90%, and most preferably about 70% to about 80% by weight based on the weight of the semi-dry developer. In particular embodiments, sufficient liquid is added to the dry developer or removed from the liquid developer to yield a semi-dry developer having a solids content of greater than 80% to about 99%, and especially 82% to 88% by weight based on the weight of the semi-dry developer.

The dry, semi-dry, and liquid developers may contain toner particles of any suitable size, typically from about 1 to about 10 microns, preferably about 1 to about 7 microns, more preferably about 1 to about 5 microns, and most preferably about 1 to about 3 microns. Unless otherwise specified, particle sizes such as for toner particles are reported as a diameter which is computed as volume average. In embodiments of the present invention, the toner particle size typically remains unchanged during the step of removing liquid from the liquid developer and during the step of adding liquid to the dry developer, unless there are one or more additional steps employed which reduce the particle size such as by further grinding.

Various instruments are known to measure the toner particle size including a Horiba CAPA-500 centrifugal particle analyzer, manufactured by Horiba Instruments, Inc. and a Malvern 3600E Particle Sizer manufactured by Malvern. Since these instruments may use different techniques to measure particle size, the readings may differ. In embodiments of the present invention, particle size is measured using the Malvern 3600E Particle Sizer or similar apparatus which uses laser diffraction light scattering of stirred samples to determine average particle sizes.

An advantage in embodiments of the present invention is that the semi-dry developer may exhibit reduced toner dusting in a dry electrostatographic process, especially for developers containing small toner particles such as from 1 to about 10 microns in size, or even smaller ranges such as from 1 to 3 microns. The degree of dustlessness may be determined by dropping 5 grams of toner material from a funnel with a ⅞ inch orifice (inside diameter) at a height of 6 inches above a sheet of bond paper and measuring the toner scatter from the roughly circular toner pile on the paper. Radiating spires of toner scatter will radiate out from the toner pile in a sunburst pattern. Although it is possible to measure the length of all the toner spires to determine an average length, for convenience, it is preferred to select and measure the longest toner spire to arrive at the value representing the length of scatter. The spire should be measured, from the edge of the toner pile to the end of the toner spire. The scatter length value is compared with the following scale of scatter to establish the appropriate dustlessness rating.

| SCALE | LENGTH OF SCATTER (INCHES) | DUSTLESS RATING |
|---|---|---|
| 1 | 0.0 TO 0.5 | No Dust (Negligible) |
| 2 | 0.5 TO 1.0 | Slightly Dusty |
| 3 | 1.0 TO 1.5 | Average |
| 4 | 1.5 TO 2.0 | Above Average |
| 5 | 2.0 and Over | Dusty |

The semi-dry developers of the present invention in embodiments are rated 1 or 2 on the Scatter Scale and exhibit no dusting or slight dusting. In contrast many conventional dry developers typically are rated 3, 4, or 5 and exhibit substantially more dusting than the semi-dry developers of the present invention.

Various suitable resins may be selected for the toner compositions of the present invention. Examples of suitable toner resins include crosslinked resins including crosslinked polyesters (reference for example copending U.S. Ser. Nos. 07/814,641 and 07/814,782, the disclosures of which are totally incorporated by reference), styrene acrylates, styrene methacrylates, polyimides, epoxies, diolefins, polyurethanes, vinyl resins, and polyesters, such as the polymeric esterification products of a dicarboxylic acid and a diol comprising a diphenol. Any suitable vinyl resin may be selected for the toner resins of the present application, including homopolymers or copolymers of two or more vinyl monomers. Typical of such vinyl monomeric units include: styrene, p-chlorostyrene, vinyl naphthalene, unsaturated mono-olefins such as ethylene, propylene, butylene, and isobutylene; vinyl halides such as vinyl chloride, vinyl bromide, vinyl fluoride, vinyl acetate, vinyl propionate, vinyl benzoate, vinyl butyrate, and the like; vinyl esters such as esters of monocarboxylic acids including methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, acrylimide; vinyl ethers, such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like. Also useful are styrene butadiene copolymers, Pliotone®, available from Goodyear Company, and mixtures thereof. Particularly preferred are a resin comprising poly-n-butylmethacrylate; a copolymer of styrene/butadiene which comprises 87 percent by weight of styrene and 13 percent by weight of butadiene; a copolymer of styrene/n-butylmethacrylate crosslinked with divinylbenzene 20–50% gel which comprises 50–60 percent by weight of styrene, 50–40 percent by weight of n-butyl methacrylate, and 0.1–0.3 percent by weight of divinylbenzene; and a copolymer of styrene/n-butyl methacrylate which comprises 50–60 percent by weight of styrene and 50–40 percent by weight of n-butyl methacrylate.

Other suitable resins include ethylene vinyl acetate (EVA) copolymers (Elvax® resins, Du Pont Company), copolymers of ethylene and an α,β-ethylenically unsaturated acid selected from the class consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), the percentages being by weight; polyethylene, polystyrene, isotactic polypropylene (crystalline), ethylene ethyl acrylate series sold under the trademark Bakelite® DPD 6169, DPDA 6182 Natural and DTDA 9169 Natural by Union Carbide Corp.; ethylene vinyl acetate resins, such as DQDA 6479 Natural and DQDA 6832 Natural 7 also sold by Union Carbide Corp.; Surlyn® ionomer resin by Du Pont Company, and the like or blends thereof. Preferred copolymers are the copolymer of ethylene and an α,β-ethylenically unsaturated acid of either acrylic acid or methacrylic acid. The synthesis of copolymers of this type are described in Rees, U.S. Pat. No. 3,264,272, the disclosure of which is totally incorporated by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min.) of 10 to 500 is determined by ASTMD 1238 Procedure A. Particularly preferred copolymers of this type have an acid number of 66 and 54 and a melt index of 100 and 500 determined at 190° C. respectively. The resin or resins are generally present in an amount of from about 30 to about 99 percent by weight of the toner composition, preferably from about 50 to about 99 percent by weight, and more preferably from about 70 to about 95 percent by weight, although they may be present in greater or lesser amounts.

Various suitable pigment particles can be employed in the toner compositions, including carbon black, like Regal 330®, magnetites comprised of a mixture of magnetic oxides, including the commercially available Mapico blacks, nigrosine dyes, other colored pigments and dyes such as cyan, magenta, yellow, blue, green, brown, and the like, and mixtures thereof, with carbon black, such as Regal 330® carbon black, being the preferred colorant. These pigment particles are present in the toner composition in an amount of from about 3 percent by weight to about 30 percent by weight. When the pigment particles are magnetites, they are present in the toner composition in the amount of from about 2 percent by weight to about 70 percent by weight, and preferably in an amount of from about 3 percent by weight to about 25 percent by weight. Dyes are present at concentrations of about 0.5 to about 20% by weight, and preferably about 0.5 to about 10% by weight.

Suitable effective internal and external charge control additives can be incorporated into or on the toner compositions of the present invention, such as quaternary ammonium compounds, as disclosed in U.S. Pat. No. 4,937,157 and U.S. Pat. No. 4,904,762, the disclosures of which are totally incorporated by reference; alkyl pyridinium compounds, including cetyl pyridinium halides and cetyl pyridinium tetrafluoroborates, as disclosed in U.S. Pat. No. 4,298,672, the disclosure of which is totally incorporated herein by reference; organic sulfate and sulfonate compounds, as disclosed in U.S. Pat. No. 4,338,390, the disclosure of which is totally incorporated herein by reference; and the like. Particularly preferred as a charge control agent is a quaternary ammonium salt selected from the group consisting of: dimethyldistearylammonium bisulfate; dimethyldistearylammonium methylsulfate; dimethyldistearylammonium sulfate; cetylpyridinium chloride; dimethyldistearylammonium hexafluorophosphate; and alkylammonium naphtholsulfonate. The charge enhancing additives are usually present in the final toner composition in an amount of from about 0.1 percent by weight to about 20 percent by weight.

Other suitable additives include one or more metal soaps, as disclosed in Trout, U.S. Pat. No. 4,707,429, the disclosure of which is totally incorporated by reference. The polyvalent metals of the metal soaps include: barium, calcium, magnesium, strontium, zinc, cadmium, aluminum, gallium, lead, chromium, manganese, iron, nickel, and cobalt. The acid portion of the metal soaps is provided by a carboxylic acid of at least 6 carbon atoms, such as caproic acid, octoic (caprylic) acid, captic acid, lauric acid, myristic acid, palmitic acid, stearic acid, oleic acid, linolic acid, erucic acid, tallitic acid, resinic acid, naphthenic acid, and the like. Examples of metallic soaps include: aluminum tristearate, aluminum distearate, barium, calcium, lead and zinc stearates; cobalt, manganese, lead and zinc linoleates; aluminum, calcium and cobalt octoates; calcium and cobalt oleates; zinc palmitate; calcium, cobalt, manganese, lead and zinc naphthenates; calcium, cobalt, manganese, lead and zinc resinsates, and the like. The metallic soap is present in 0.01 to 60 percent by weight, preferably 0.5 to 35% by weight based on the total weight of the developer solids.

Flow aid agents may be blended with single and two component developers. Flow aids include $SiO_2$, $Al_2O_3$, SnO, $TiO_2$, ZnO and the like, alone, in mixtures, or surface treated with silanes. Other flow aids are polymeric particles such as acrylic, styrenic, fluorinic, silicone, and the like available, for example, from Nippon Paint, Osaka, Japan. Flow aid particle sizes typically range from less than about 0.01 microns to about 2 microns.

Various suitable carrier materials may be selected for formulating the developer composition of the present invention, providing that these carrier particles are capable of triboelectrically obtaining a charge of opposite polarity to that of the toner particles. Examples of these carriers include materials such as glass, steel, nickel, ferrites like copper and zinc, silicon dioxide and the like, with metallic carriers, especially magnetic carriers being preferred. These carriers can be used with or without a coating, examples of coatings including resins such as polystyrene, homopolymers, copolymers, and terpolymers; polymers of halogen containing ethylenes including vinyl fluorides, vinylidene fluorides, vinyl chlorides, vinylidene chlorides, chlorotrifluoroethylene, a vinyl chloride/chlorotrifluoroethylene copolymer, a vinyl chloride/vinyl acetate copolymer, a chlorotrifluoroethylene polymer, and various known vinyl chloride terpolymers. Acrylic polymers and copolymers typified by polymethylmethacrylate and siloxane polymers are also useful carrier coatings, particularly when negative charging toners are desired. Coated carrier particles with a diameter of, for example, from about 25 to about 1,000 microns, preferably about 40 to about 150 microns, can be selected providing these particles with sufficient density and inertia to avoid adherence to the electrostatic image during the development process. Many of the typical carriers that can be used are described in U.S. Pat. Nos. 2,618,441; 2,638,522; 3,533,835; 3,526,533; 3,590,000; 3,847,604; 3,767,598; 4,233,387; 4,935,326; and 4,937,166, the disclosures of which are totally incorporated by reference.

The dry developer employed in embodiments of the present invention may be prepared by any conventional process such as those illustrated, for example, in Bergen et al., U.S. Pat. No. 4,233,388, and Laing et al., U.S. Pat. No. 4,678,734, the disclosures of which are totally incorporated by reference. Another process to prepare developer compositions is illustrated in Fuller, U.S. appln. Ser. No. 07/358,973 (filed May 30, 1989, attorney docket number D/88089), the disclosure of which is totally incorporated by reference. Typically, toner particles comprising resin particles, pigment particles, and optionally one or more charge control agents are prepared by, for example, extrusion and then reduced in size by grinding to the desired particle size. A classification step may be employed to narrow the particle size distribution. Carrier particles and flow aids may optionally be blended with the toner particles. In embodiments of the present invention, the dry developer may contain no liquid component or may contain one or more liquid components that are present in an amount less than about 10% by weight, preferably from about 0.01% to about 5% by weight of the dry developer.

The liquid developer employed in embodiments of the present invention may be prepared by any conventional process such as those illustrated, for example, in Larson et al., U.S. Pat. No. 4,760,009; Taggi, U.S. Pat. No. 4,670,370; Blair et al., U.S. Pat. No. 4,923,778; Trout et al., U.S. Pat. No. 4,783,389; and Larson et al., U.S. Pat. No. 5,017,451, the disclosures of which are totally incorporated by reference. Formulations of liquid developers are illustrated for example in Trout, U.S. Pat. No. 4,707,429; Felder, U.S. Pat. No. 5,019,477; and Adair et al., U.S. Pat. No. 4,994,341, the disclosures of which are totally incorporated by reference. Liquid developers suitable in embodiments of the present invention typically have a solids content of less than about 50% by weight, preferably from about 0.1 to about 25% by weight, and more preferably from about 5 to about 20% by weight based on the weight of the liquid developer.

In embodiments of the present invention, the liquid component of the liquid developer, a portion of which is removed to yield the semi-dry developer, and the liquid additive added to the dry developer may be a compound typically used as a release agent to reduce the offset phenomenon, involving the undesired adherence of toner to the fuser roll, which may occur during fusing of the toner particles to the support material. Any suitable polymeric release material having functional groups may be employed. Typical polymeric release agents are described in U.S. Pat. No. 4,101,686, which describes polyorganosiloxane fluids as release agents, the disclosure of which is totally incorporated by reference. Other exemplary polymeric release agents having functional groups are described in U.S. Pat. Nos. 4,046,795, 4,029,827 and 4,011,362, the disclosure of which are totally incorporated by reference. For the embodiments wherein the liquid additive is added to the dry developer, the liquid additive may be a polymeric release agent which is solid at room temperature but which is a fluid at operating temperatures. In preferred embodiments, the chemically reactive groups of polymeric release material are mercapto, carboxy, hydroxy, isocyanate, epoxy, and amino. The most preferred polymeric release agents having functional groups thereon used in accordance with the present invention are the mercapto functional polyorganosiloxanes described in U.S. Pat. No. 4,101,686 and 4,029,827. Preferred release agents include fluorinated oils based on perfluoroalkyl polyethers such as Krytox 143 available from Du Pont in a molecular weight of from about 2,000 to 7,000 or fluorinated greases prepared by thickening Krytox fluorinated oils with short chain telomers of tetrafluoroethylene available from Du Pont as Krytox 240; carboxy compounds such as n- or isovaleric, n- or isocaproic, n-heptoic, n-caprytic, pelargonic, captic and undecrylenic acids alone or in mixtures; alcohols prepared by hydrogenating glycerides to yield long chain materials ($C_{12}$ or larger) such as lauryl alcohol, other alcohols such as n-octyl, n-nonyl, n-decyl alone or in mixtures; ethers, such as diethyleneglycol dibutyl ether, diethylene glycol mono-n-butyl ether, ethyleneglycolmonophenyl ether alone or in mixtures; olefinic oligomers of ethylene, propylene, butylene, methyl pentene, and the like, alone or in mixtures. When the liquid contained in the semi-dry developer has the properties of a release agent, an advantage is that the fusing subsystem no longer needs to include release agent delivery devices, such as those illustrated in Schram, U.S. Pat. No. 4,496,234, to deliver release agents to the fuser and/or pressure rolls since the toner already contains the release agent.

The invention will now be described in detail with respect to specific preferred embodiments thereof, it being understood that these examples are intended to be illustrative only and the invention is not intended to be limited to the materials, conditions or process parameters recited herein. All percentages and parts are by weight unless otherwise indicated.

EXAMPLE 1

One black liquid developer and one magenta liquid developer were prepared as follows by adding the resin(s), pigment(s), aluminum distearate, and Isopar® L carrier liquid to a Union Process Attritor. The Isopar® L concentrations are 77.1% by weight in the magenta developer and 73% by weight in the black developer. The attritor was steam heated and the materials were blended at 80° C. to 100° C. for one hour. The attritor was then cooled at ambient temperature, about 25° C. and more Isopar® L is added. After addition of more Isopar® L carrier liquid, the Isopar® L concentrations are 86.5% by weight in the magenta developer and 85% by weight in the black developer. The grinding was continued at a grinding speed of about 100 rpm until a toner particle size of less than about 2 microns was obtained. The Isopar® L soluble ingredients, i.e., Basic Barium Petronate ("BBP") and Nuxtra LTD, were then added. Nutra LTD is believed to reduce toned image speckle. Basic Barium Petronate (available from Witco Chemical Corp., New York, N.Y.) petroleum sulfonate is a natural sulfonate with an alkalinity present as barium carbonate having a total base number ("TBN") of 70. TBN is the number of mg's of KOH required to equal the number of base equivalents in 1 gram of material. The percentage of Barium sulfonate is 40–45%, percentage of Barium is 14%, percentage of oil is 43%, and the molecular weight is 1100. Nutra LTD (available from Huls America Inc., Piscataway, N.J.) is a mixture of Bi and Ca 2-ethylhexoates in mineral spirits. The total metal content is 18% by weight. The specific formulations and process conditions were as follows:

| SOLIDS | MAGENTA TONER | BLACK TONER |
|---|---|---|
| % Nucrel 599 | 55.5 | 80.0 |
| % Pliotone 3002 | 18.5 | — |
| % Pigment | 8.8(R6713)<br>16.3(R6700) | 18.6(Sterling NS)<br>0.4(NBD 7010) |
| % Alum.Distearate | 1.0 | 1.0 |
| Post Additives | 1.25(% Nutra LTD)<br>12.0(mg/g BBP) | 1.25(% Nutra LTD)<br>1.0(mg/g BBP) |
| PROCESS | | |
| BatchSolids(lbs) | 96 | 120 |
| Hot Grind: | | |
| % Solids | 22.9 | 27.0 |
| Temp(C.) | 100 | 80 |
| Time(hrs) | 1 | 1 |
| Cold Grind(1): | | |
| % Solids | 16 | 17.5 |
| Temp(C.) | 40–60 | 40–60 |
| Time(hrs) | 2 | 2 |
| Cold Grind(2): | | |
| % Solids | 13.5 | 15 |
| Temp(C.) | 30 | 30 |
| Time(hrs) | 6 | 6 |

The toner resin contained Nucrel 599 available from Du Pont (composed of 90% by weight of ethylene and 10% by weight of methacrylic acid) and/or Pliotone 3002 available from Goodyear (a 12% by weight vinyltoluene/88% by weight butadiene copolymer. For the magenta toner, the Nucrel/Pliotone resins were in a ratio by weight of 3/1. The composition of the pigments was as follows: Sterling NS (Cabot Corp., Boston, Mass.) carbon black; Heliogen Blue NBD 7010 (BASF Corp., Chemical Division, Cherry Hill, N.J.) CI Pigment Blue 15:3, copper phthalocyanine, $C_{32}H_{16}CuN_8$; Quindo Red R-6700 (Mobay Chemical Corp., Union, N.J.) Quinacridone, CI Pigment Violet 19; Quindo Red R-6713 (Mobay Chemical Corp., Union, N.J.) Quinacridone, Pigment Red.

After their preparation as described above, the resulting black and magenta liquid developers both had a solids content of about 10% by weight.

A portion of the Isopar® hydrocarbon carrier liquid was then removed from the black and magenta liquid developers by pressure filtration. A piston press was filled (660 ml) with the black or magenta liquid developer having a solids content of about 10% by weight and was run for about 15 hours under 60 psig water pressure to obtain a toner solids content of about 70 wt. % for the black toner and 68 wt. % for the magenta toner, respectively. The filtration equipment employed was a lab size pneumatic/hydraulic piston filter. The press was a blind end cylinder with chrome plated bore. The blind end was fitted with a hydraulic port. A piston with "O-ring" seals floated free in the cylinder. The open end of the cylinder was threaded to accept a retaining collar. An end cap, containing a perforated filtrate collection plate, filter media, and a flat Buna N ring gasket, was locked into position by the retaining collar. A section of pipe which fits over short rods screwed into the collar was used to pull up the collar threads. The hydraulic port was connected by hose to an air-water pump capable of providing 4500 psig hydraulic pressure with a 100 psig air supply. Air supply was conditioned and controlled by the valve and regulator. Water was used instead of oil to feed the hydraulic pump. Filters were cut to fit the insert (3 11/16 inches). Standard heavy duty filter cloth used as a continuous belt on the Larox, Inc. Automatic Pressure Filter was used.

Each toner was blended with carrier particles designed to tribo charge the toner either positive or negative. The carrier particles ranged in size from about 100 to about 200 microns in diameter. The positive toner tribo charging carrier was a steel core coated with a 90/10 wt. % ratio of polyvinylidene-fluoride and polymethylmethacrylate. The negative toner tribo charging carrier was composed of a ferrite particle coated with a terpolymer of 15% by weight styrene, 80% by weight methylmethacrylate and a 5% by weight silane. Each carrier coating was about 0.5 wt. % based on the total weight of the core and coating. The toners were combined with the above carriers to form two component developers containing a toner concentration ("Tc") ranging from less than about 1% to about 2% by weight based on total weight of developer. The developers were in a glass jar, roll milled for predetermined time intervals (10, 30, and 60 minutes) and measured for relative triboelectric charge. The relative triboelectric values generated by contact of carrier particles with the toner particles were measured by means of a Faraday Cage. The device comprises a steel cylinder having a diameter of about one inch and a length of about one inch. A 400-mesh screen is positioned at each end of the cylinder. The cylinder is weighed, charged with about 0.5 gram mixture of carrier and toner particles and connected to ground through a capacitor and an electrometer connected in parallel. Dry compressed air is then blown through the steel cylinder to drive all the toner from the carrier. The charge on the capacitor is then read on the electrometer. Next, the chamber is reweighed to determine the weight loss. The resulting data is used to calculate the toner concentration and the charge in microcoulombs per gram of toner. Since the triboelectric measurements are relative, the measurements should, for comparative purposes, be conducted under substantially identical conditions.

The results of the triboelectric charge measurements are shown in Table 1 for the positive toner tribo charging carriers and in Table 2 for the negative toner tribo charging carriers.

TABLE 1

(Positive Toner Tribo Charging Carrier)

| Toner | Time(min.) | Tribo μc/g | Tc % | *TCP |
|---|---|---|---|---|
| Black Toner | 10 | 8.9 | 1.0 | 8.9 |
| | 30 | 4.3 | 0.98 | 4.2 |
| | 60 | 3.4 | 1.56 | 5.4 |
| Magenta Toner | 10 | 14.7 | 1.2 | 17.7 |
| | 30 | 4.4 | 1.4 | 6.1 |
| | 60 | 2.8 | 1.3 | 3.7 |

TABLE 2

(Negative Toner Tribo Charging Carrier)

| Toner | Time(min.) | Tribo μc/g | Tc % | *TCP |
|---|---|---|---|---|
| Black Toner | 10 | −1.9 | 0.93 | −1.8 |
| | 30 | −2.1 | 0.99 | −2.11 |
| | 60 | −4.7 | 0.88 | −4.2 |
| Magenta Toner | 10 | −2.4 | 1.98 | −4.8 |
| | 30 | −7.5 | 1.24 | −9.3 |
| | 60 | −10.8 | 1.73 | −13.2 |

*TCP = Toner Concentration × Tribo Charge

The triboelectric charge measurements show that each toner composition may be charged positive or negative even when containing about 32 wt. % hydrocarbon liquid. The triboelectric charge values are typical of dry toner compositions disclosed, for example, in U.S. Pat. Nos. 4,263,389; 4,291,112 and 4,294,904, the disclosure of which is totally incorporated by reference.

EXAMPLE 2

The magenta toner with negative tribo charging carrier developer was placed in a developer tray of a xerographic imaging test fixture (plate processor) and was used to produce copies. The selenium photoreceptor plate was corona charged positive, exposed to an original print and cascade developed with the magenta developer. The toner in the developer was attracted to the latent positive electrostatic image which was then transferred to paper and fused. The selenium plate was cleaned of residual toner and used again to produce another copy. The copy produced had a clean image and clean background and was adequately fused to the paper. There was no spotting or odor from residual hydrocarbon liquid evident on the copy paper.

It will be understood that various changes in the details, materials, steps and arrangements of parts which have been herein described and illustrated in order to explain the nature of the invention, will occur to and may be made by those skilled in the art upon a reading of this disclosure, and such changes are intended to be included within the principle and scope of this invention.

We claim:

1. A dry electrostatographic process comprising:

(a) creating a latent image; and (b) developing the latent image in a dry development process with a semi-dry developer having a solids content ranging from about 50% to about 99% by weight based on the weight of the semi-dry developer, and wherein the semi-dry developer is prepared by a process comprising: (i) removing liquid from a liquid developer.

2. The process of claim 1, wherein the semi-dry developer prepared by step (i) is a single component developer, and the developer preparation process further comprises adding carrier particles to the semi-dry single component developer to form a semi-dry two component developer.

3. The process of claim 1, wherein the liquid in step (i) is removed by blotting, filtration or a combination thereof.

4. The process of claim 1, wherein the liquid in step (i) is removed by high pressure filtration at a pressure ranging from about 60 to about 2,500 psig.

5. The process of claim 1, wherein the semi-dry developer contains toner particles ranging in size of from 1 to about 10 microns.

6. The process of claim 1, wherein the semi-dry developer contains toner particles ranging in size of from 1 to about 3 microns.

7. The process of claim 1, wherein the solids content of the semi-dry developer ranges from about 60% to about 95% by weight based on the weight of the semi-dry developer.

8. The process of claim 1, wherein the solids content of the semi-dry developer ranges from about 70% to about 90% by weight based on the weight of the semi-dry developer.

9. The process of claim 1, wherein the liquid in the semi-dry developer is an aliphatic hydrocarbon containing from 1 to about 25 carbon atoms.

10. The process of claim 1, wherein the liquid in the semi-dry developer is a release agent for reducing toner offset.

11. The process of claim 1, wherein the latent image is developed by the semi-dry developer in step (b) by cascade development, magnetic brush development, fur brush development, scavengeless development, or jumping development.

12. The process of claim 1, wherein the liquid developer in step (i) has a solids content of less than 50% by weight.

13. The process of claim 1, wherein the liquid developer in step (i) has a solids content of about 0.1 to about 25% by weight.

14. The process of claim 1, wherein step (a) comprises creating the latent image on a latent image member, and further comprising: (c) transferring the toned latent image to a support substrate and fixing the toned latent image to the support substrate.

* * * * *